US006390467B1

(12) United States Patent
Fukube

(10) Patent No.: US 6,390,467 B1
(45) Date of Patent: May 21, 2002

(54) TRANSFER SHEET CONVEYING DEVICE FOR IMAGE FORMING APPARATUS WITH IMPROVED OPERABILITY OF REMOVING A JAMMED SHEET

(75) Inventor: Noriaki Fukube, Ohta-ku (JP)

(73) Assignee: Ricoh Company, Ltd., Tokyo (JP)

( * ) Notice: Subject to any disclaimer, the term of this patent is extended or adjusted under 35 U.S.C. 154(b) by 1 days.

(21) Appl. No.: 09/608,170

(22) Filed: Jun. 30, 2000

(30) Foreign Application Priority Data

Jul. 1, 1999 (JP) ..... 11-187125

(51) Int. Cl.[7] ..... B65H 7/00
(52) U.S. Cl. ..... 271/256; 271/272
(58) Field of Search ..... 271/242, 272, 271/116, 256

(56) References Cited

U.S. PATENT DOCUMENTS 5,246,224 A * 9/1993 Matsuno et al. ..... 271/242
5,543,909 A * 8/1996 Quesnel ..... 271/242 X
5,775,690 A * 7/1998 Quesnel et al. ..... 271/242
5,904,350 A * 5/1999 Creighton et al. ..... 271/227
5,967,506 A * 10/1999 Miki et al. ..... 271/10.13
6,092,803 A * 7/2000 Munenaka ..... 271/242

FOREIGN PATENT DOCUMENTS

JP 2-18244 * 1/1990 ..... 271/242
JP 6-16261 1/1994
JP 7-206198 8/1995

* cited by examiner

*Primary Examiner*—David H. Bollinger
(74) *Attorney, Agent, or Firm*—Oblon, Spivak, McClelland, Maier & Neustadt, P.C.

(57) ABSTRACT

A pair of grip rollers forming a slack in a transfer sheet by impinging the transfer sheet against a pair of registration rollers that are at a standstill, includes a one-way rotating clutch. A coil spring biases the one-way rotating clutch such that projections on a flange of the one-way rotating clutch engage with holes on a rear sideboard. When a transfer sheet caught by the pair of grip rollers is pulled out with a predetermined or greater torque in an opposite direction to that in which the transfer sheet is conveyed, the projections are disengaged with the holes, against the coil spring bias. Thereby the one-way clutch is set free and can be rotated in a reverse direction.

6 Claims, 4 Drawing Sheets

TRANSFER SHEET CONVEYING DEVICE FOR IMAGE FORMING APPARATUS WITH IMPROVED OPERABILITY OF REMOVING A JAMMED SHEET

BACKGROUND OF THE INVENTION

1. Field of the Invention

The present invention relates to a transfer sheet conveying device for use in an image forming apparatus such as a copying machine, a facsimile, a printer, etc., and more particularly to a transfer sheet conveying device forming a slack in a transfer sheet by impinging the transfer sheet driven by a pair of transfer sheet conveying rollers upon a pair of registration rollers which are at a standstill.

2. Discussion of the Background

In an image forming apparatus, a pair of registration rollers are arranged in the vicinity of an upstream side (in a sheet conveying direction) of a photoconductive element. A leading edge of a transfer sheet conveyed by a pair of transfer sheet conveying rollers (hereinafter referred to as pair of grip rollers) impinges upon a pair of registration rollers, which are at a standstill, and thereby a slack is formed in the transfer sheet, i.e., the transfer sheet is bowed, to correct a skew of the transfer sheet.

The transfer sheet, the skew of which is corrected, is then conveyed by the pair of registration rollers to a transfer section in synchronization with a visible image (a toner image) formed on the photoconductive drum. The visible image is transferred onto the transfer sheet by a transfer charger and a transfer roller or a transfer belt at the transfer section.

In forming a slack in a transfer sheet between the pair of grip rollers and the pair of registration rollers, when the transfer sheet is relatively thick and rigid, the pair of grip rollers may be rotated in an opposite direction so that the transfer sheet is conveyed by a return force caused by the resilience of the slack in the transfer sheet. Thereby, a proper slack in a transfer sheet may not be formed.

A one-way rotating clutch has been employed in the pair of grip rollers to obviate the above-described inconvenience. The one-way rotating clutch is also configured to idle the pair of grip rollers when the pair of registration rollers conveys a transfer sheet so as to reduce a transportation load imposed on the pair of grip rollers.

When a transfer sheet is jammed and is caught by the pair of grip rollers, the jammed sheet can be easily removed by being pulled out from a downstream side of the pair of grip rollers because the pair of grip rollers are idled. However, when the jammed sheet is removed from an upstream side of the pair of grip rollers, a substantial force is required to pull out the jammed sheet because the pair of grip rollers are locked by the one-way rotating clutch. Further, the transfer sheet may tear, and a piece of torn transfer sheet may remain inside the apparatus, causing another transfer sheet to jam when the next transfer sheet is conveyed.

SUMMARY OF THE INVENTION

The present invention has been made in view of the above-discussed and other problems and addresses the above-discussed and other problems.

The present invention advantageously provides a novel transfer sheet conveying device with an improved ability to remove a jammed sheet while securing an adequate slack in a transfer sheet, thereby insuring high transfer sheet conveying quality.

According to an embodiment of the present invention, a transfer sheet conveying device for use in an image forming apparatus, comprises a pair of transfer sheet conveying rollers to convey a transfer sheet and a pair of registration rollers arranged at a downstream side of said pair of transfer sheet conveying rollers. The pair of transfer sheet conveying rollers can convey and impinge the transfer sheet upon said pair registration rollers so as to form a slack in the transfer sheet. A one-way rotating clutch mounts the pair of transfer sheet conveys rollers such that they idle in a transfer sheet conveying direction and have a predetermined torque in an opposite direction thereto, wherein the one-way rotating clutch is itself mounted to rotate in the opposite direction in response to a force in the opposite direction. As a result, a jammed transfer sheet can easily be removed.

Other objects, features and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
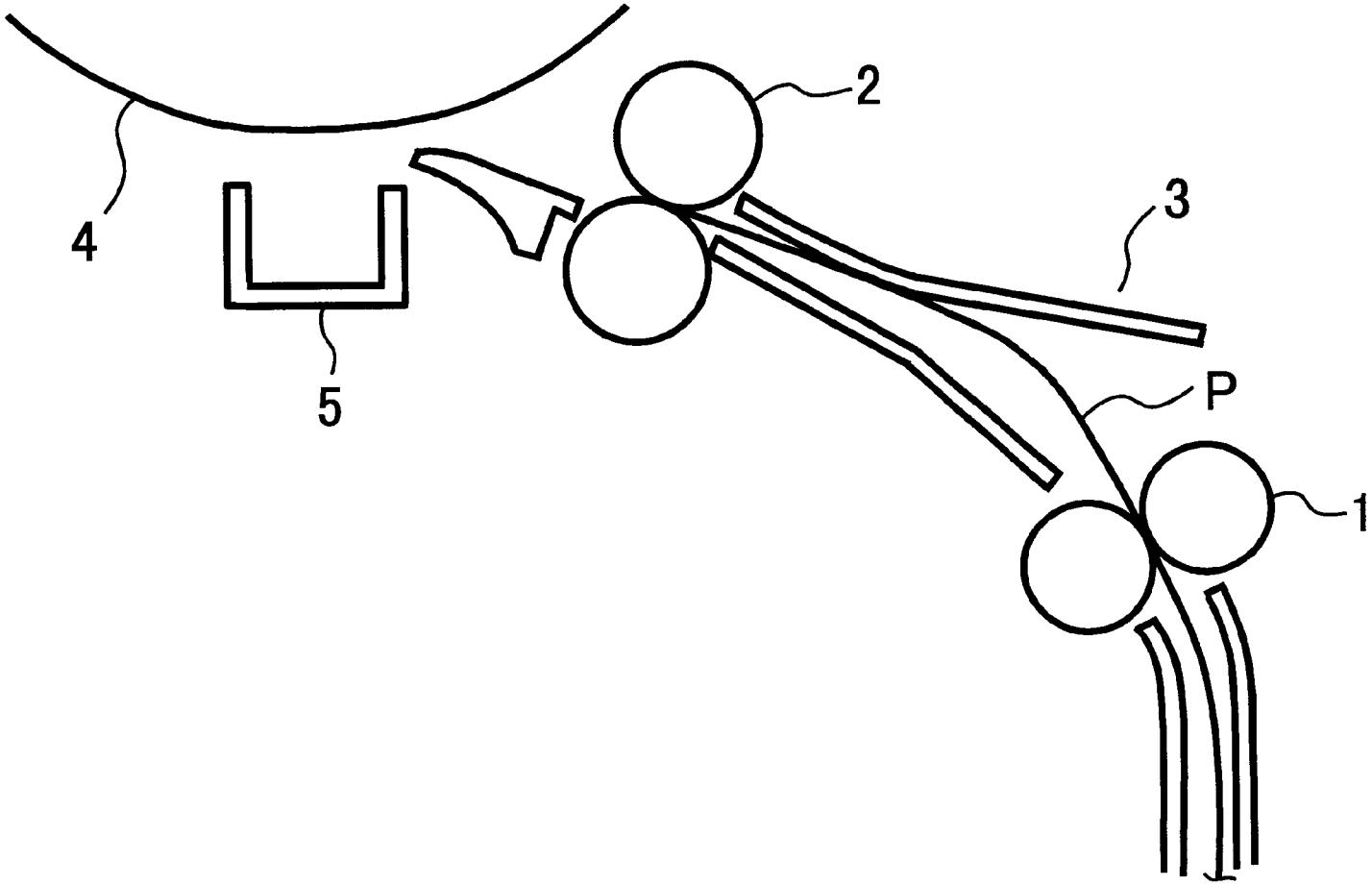
FIG. 1 is a schematic drawing illustrating a sheet conveying device.

Referring now to the drawings, wherein like reference numerals designate identical or corresponding parts throughout the several views, FIG. 1 is a schematic drawing illustrating a sheet conveying device.

In an image forming apparatus, the sheet conveying device, located at an upstream side of a transfer section, includes a pair of grip rollers 1, and a pair of registration rollers 2 which are disposed at a downstream side of the pair of grip rollers 1. A guide plate 3 is provided between the pair of grip rollers 1 and the pair of registration rollers 2, in a shape that does not interfere with a transfer sheet P having a slack.

In the vicinity of a downstream side of the pair of registration rollers 2, a transfer charger 5 is located opposite to a photoconductive drum 4. Devices required for a process of electrophotographic image formation such as a charging device, a developing device, a separating device, a cleaning device, a discharging device and so forth (not shown) are disposed around the photoconductive drum 4.

The transfer sheet P conveyed from a sheet feeding unit is caught by the pair of grip rollers 1 and then is conveyed to the pair of registration rollers 2. A leading edge of the transfer sheet P being conveyed by the pair of grip rollers 1 impinges upon a nip formed between the pair of registration rollers 2, which are at a standstill, and thereby the transfer sheet P forms a slack to correct a skew of the transfer sheet.

Then the transfer sheet P is conveyed to a transfer section by the pair of registration rollers 2 in synchronization with a visible image formed on the photoconductive drum 4. The visible image is transferred onto the transfer sheet P by a transfer charger. The transfer sheet P having the transferred image is conveyed to a fixing section (not shown) to be fixed, and then is discharged by a transfer sheet discharging unit.

Figure 2:
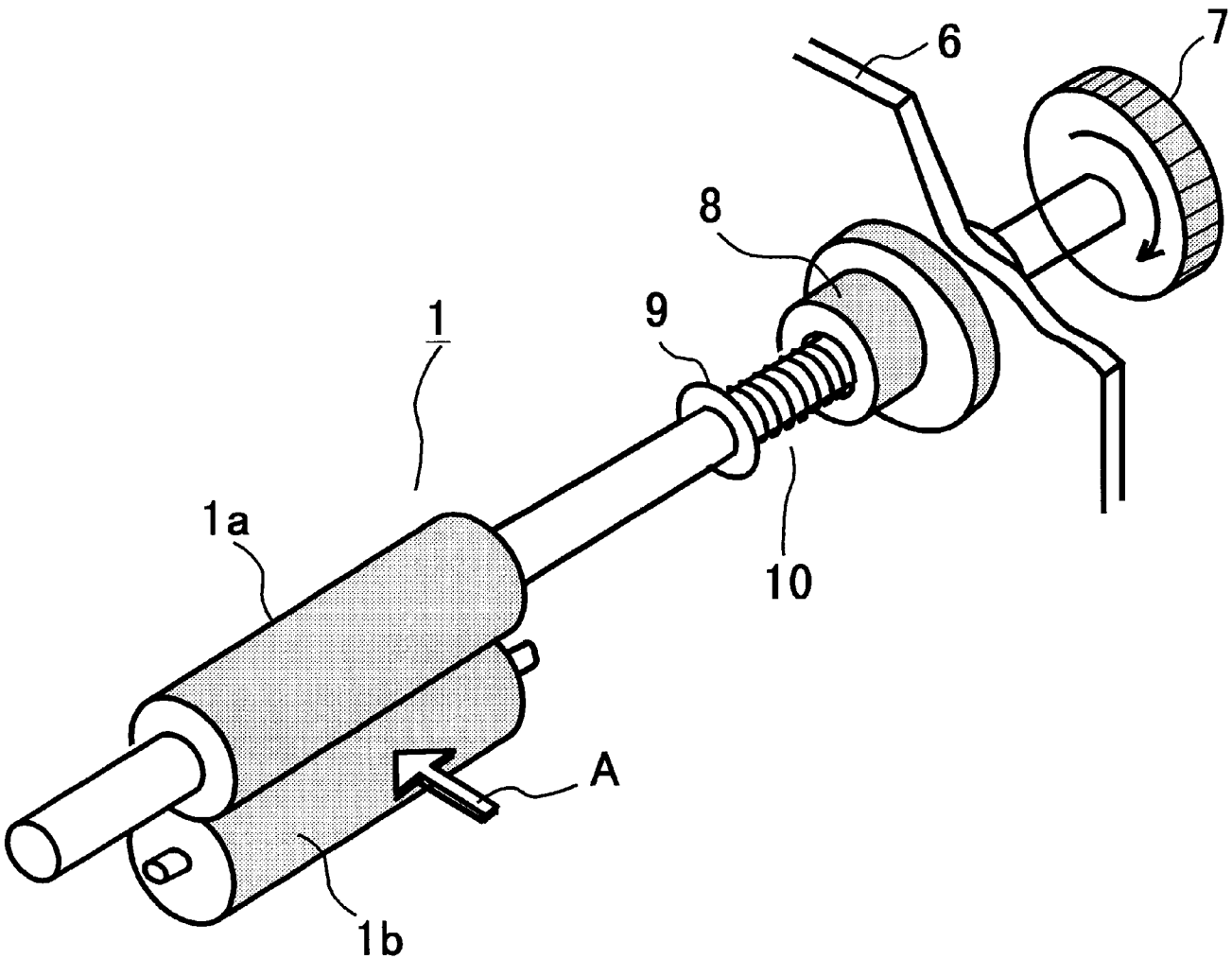
FIG. 2 is a perspective view illustrating a driving mechanism of a grip roller which is a main part of a sheet conveying device.
Figure 3:
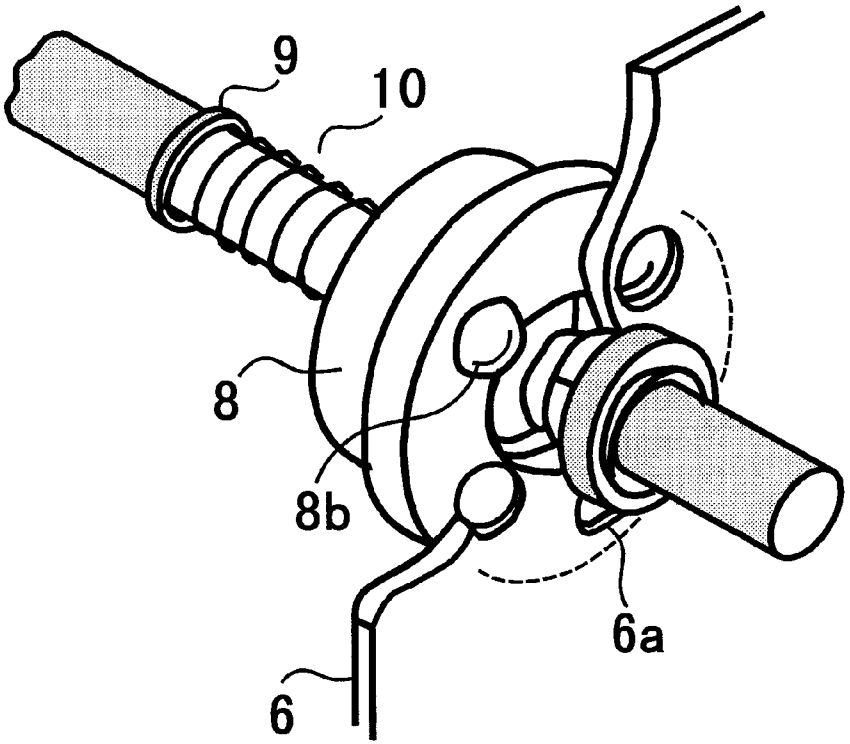
FIG. 3 is a rear elevation illustrating a part of FIG. 2.

The pair of grip rollers 1 is supported by a front sideboard (not shown) and a rear sideboard 6 illustrated in FIG. 2 and is controlled by a driving device (not shown) external of the rear sideboard 6.

The pair of grip rollers 1 includes a drive roller 1*a* and a driven roller 1*b*. A one-way rotating clutch 8 is provided for the drive roller 1*a* in proximity to the rear sideboard 6. The one-way rotating clutch 8 is biased toward the rear sideboard 6 by one end of a coil spring 10 while the other end of the coil spring 10 is latched by an E ring 9. An arrow A in FIG. 2 indicates a direction that the transfer sheet P is conveyed.

Figure 4:
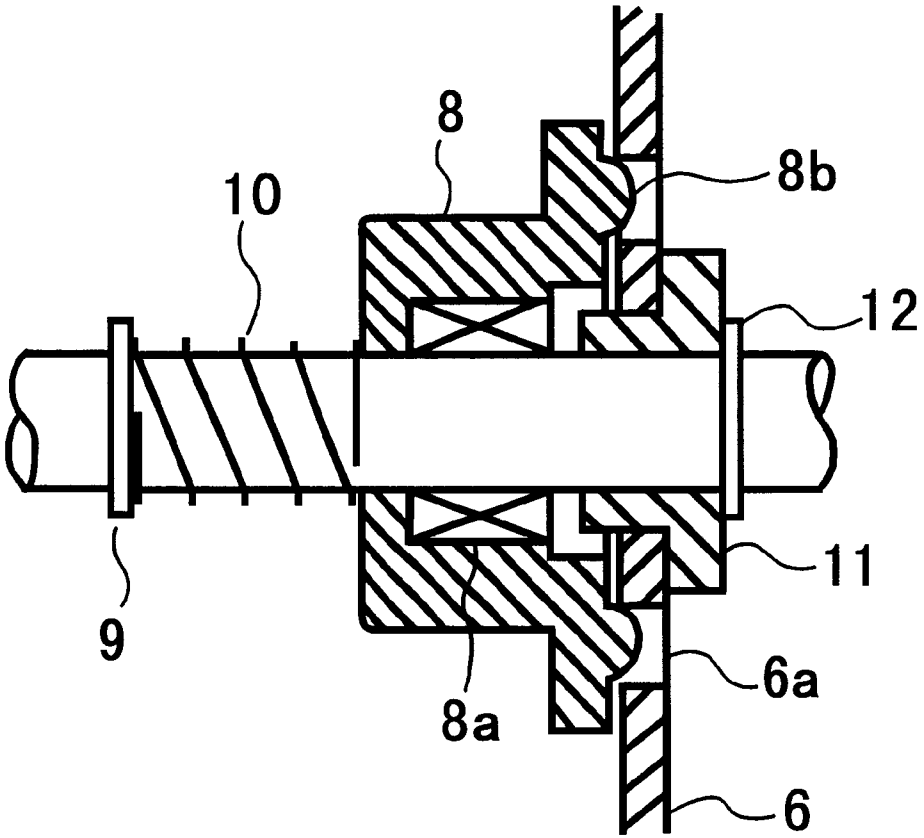
FIG. 4 is a sectional view illustrating a part of FIG. 2.

The one-way rotating clutch 8 includes a one-way rotating clutch part 8*a* as illustrated in FIG. 4. The one-way rotating clutch part 8*a* is configured to idle when the pair of grip rollers 1 rotates in the direction that the transfer sheet P is conveyed and to lock when the pair of grip rollers 1 rotates in the reverse direction, respectively. A flange of the one-way rotating clutch 8 contains a plurality of projections 8*b* in a circle. Holes 6*a* corresponding to the projections 8*b* are provided in the rear sideboard 6. The reference numeral 11 is a bearing for a spindle of the respective one of the pair of grip rollers 1, and the reference numeral 12 is a stopper ring for the spindle 11.

As described above, the one-way rotating clutch 8 is normally biased toward the rear sideboard 6 by the coil spring 10 so that the projections 8*b* engage the holes 6*a* on the rear sideboard. Because the pair of grip rollers 1 are driven to rotate in the direction that the transfer sheet P is conveyed, the one-way rotating clutch part 8*a* idles when the pair of grip rollers 1 are driven.

When a transfer sheet, caught by the pair of grip rollers 1 due to a jam, is pulled out in an opposite direction to that in which the transfer sheet is conveyed from an upstream side of the pair of grip rollers 1, the one-way rotating clutch part 8*a* is locked and then the one-way rotating clutch 8 rotates together with the pair of grip rollers 1. When a predetermined force is applied to the one-way rotating clutch 8, the projections 8*b* escape from the holes 6*a* to release the engagement while compressing the coil spring 10.

Because the one-way rotating clutch 8 is moved by the above-described force in a direction to separate from the rear sideboard 6, the projections 8*b* are disengaged from the holes 6*a*, and thereby the pair of grip rollers 1 can rotate in the opposite direction to that in which the transfer sheet is conveyed. As a result, the transfer sheet can be easily pulled out and it is less likely that a piece of torn transfer sheet remains inside the apparatus.

A one-way rotating clutch combined with an integral spring-type torque limiter is commonly known in the art and therefore the known product may be used instead of the described embodiment of the present invention. However, with the one-way rotating clutch 8 according to the embodiment of the present invention, the construction can be made simpler and the removal of jammed sheet can be made reliable.

A relationship between the projections 8*b* and the holes 6*a* can be the inverse to the relationship described above, and projections on the rear sideboard 6 can instead be stamped with a embossing press. It also can be constructed without projections and holes by having a friction member such as a rubber cork on abutting surfaces of the rear sideboard 6 and the one-way rotating clutch 8. In this construction, however, a cost advantage may not be greater than that of the present invention. Further, the mechanism to hold the one-way rotating clutch 8 to the rear sideboard 6 by projections and holes can easily be manufactured.

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. JPAP11-187125, filed on Jul. 1, 1999, and the entire contents thereof are herein incorporated by reference.

What is claimed as new and is desired to be secured by Letters Patent of the United States is:

1. A transfer sheet conveying device for use in an image forming apparatus, comprising:

a pair of transfer sheet conveying rollers; and a pair of registration rollers arranged at a downstream side of said pair of transfer sheet conveying rollers, wherein said pair of transfer sheet conveying rollers can convey and impinge a transfer sheet upon said pair registration rollers to form a slack in the transfer sheet, and a one-way rotating clutch mounting said pair of transfer sheet conveying rollers such that said pair of transfer sheet conveying rollers idle in a transfer sheet conveying direction and have a predetermined torque in an opposite direction to the transfer sheet conveying direction, wherein said one-way rotating clutch is itself mounted to rotate in said opposite direction in response to a force in said opposite direction.

2. A transfer sheet conveying device according to claim 1, wherein said one way clutch is press-contacted with a fixed surface by a bias applying device having a predetermined bias force set such that said one-way rotating clutch will rotate in said opposite direction in response to a force greater than that required for forming the slack in the transfer sheet but within a limit of tension of the transfer sheet.

3. A transfer sheet conveying device according to claim 2, wherein one of said one-way rotating clutch and said fixed surface includes holes and the other of said one-way rotating clutch and said fixed surface includes projections held in said holes by said bias applying device.

4. A transfer sheet conveying device for use in an image forming apparatus, comprising:

a pair of transfer sheet conveying rollers; and a pair of registration rollers arranged at a downstream side of said pair of transfer sheet conveying rollers, wherein said pair of transfer sheet conveying rollers can convey and impinge a transfer sheet upon said pair registration rollers so as to form a slack in the transfer sheet, and clutching means for enabling said pair of transfer sheet conveying rollers to idle in a transfer sheet conveying direction, and to have a predetermined torque in an opposite direction to the transfer sheet conveying direction.

5. A transfer sheet conveying device according to claim 4, wherein clutching means are press contacted with a fixed surface by a bias applying device having a predetermined bias force set such that said clutching means will rotate in said opposite direction in response to a force greater than that required for forming the slack in the transfer sheet but within a limit of tension of the transfer sheet.

6. A transfer sheet conveying device according to claim 5, wherein one of said clutching means and said fixed surface includes holes and the other of said clutching means and said fixed surface includes projections held in said holes by said bias applying device.

* * * * *